US012495827B2

(12) United States Patent
Vido

(10) Patent No.: US 12,495,827 B2
(45) Date of Patent: Dec. 16, 2025

(54) SANITARY ORAL INTERFACE

(71) Applicant: Vido Manufacturing and Distribution Corp., Parker, CO (US)

(72) Inventor: Robert Vido, Parker, CO (US)

(73) Assignee: Vido Manufacturing and Distribution Corp., Denver, CO (US)

( * ) Notice: Subject to any disclaimer, the term of this patent is extended or adjusted under 35 U.S.C. 154(b) by 535 days.

(21) Appl. No.: 18/065,494

(22) Filed: Dec. 13, 2022

(65) Prior Publication Data

US 2023/0180824 A1 Jun. 15, 2023

Related U.S. Application Data

(60) Provisional application No. 63/265,333, filed on Dec. 13, 2021.

(51) Int. Cl.

| | |
|---|---|
| ***A24F 7/02*** | (2006.01) |
| ***A24D 3/18*** | (2006.01) |
| ***A24F 7/00*** | (2006.01) |

(52) U.S. Cl.
CPC ..... *A24F 7/00* (2013.01)

(58) Field of Classification Search
CPC ..... A24D 3/18; A24F 7/00; A24F 7/02
See application file for complete search history.

(56) References Cited

U.S. PATENT DOCUMENTS

| | | | | |
|---|---|---|---|---|
| 1,135,504 | A | 4/1915 | Fernanzo | |
| 3,133,545 | A | 5/1964 | Arthur | |
| 3,375,920 | A | 4/1968 | Shaw | |
| 10,863,768 | B2 | 12/2020 | Besso et al. | |
| 2008/0029111 | A1 | 2/2008 | Dube et al. | |
| 2015/0047658 | A1* | 2/2015 | Cyphert | A61M 11/003 131/329 |
| 2019/0159513 | A1 | 5/2019 | Grisham | |
| 2019/0223494 | A1 | 7/2019 | Knauseder et al. | |
| 2019/0274355 | A1 | 9/2019 | Cyphert et al. | |
| 2020/0146345 | A1* | 5/2020 | Bradley | A24F 1/30 |

FOREIGN PATENT DOCUMENTS

| | | | |
|---|---|---|---|
| WO | WO-2015069391 A1 * | 5/2015 | A24F 7/00 |

OTHER PUBLICATIONS

1 Office Action issued in related Canada patent application No. 3,183,907, dated May 23, 2024, 6-pages.

* cited by examiner

*Primary Examiner* — Cynthia Szewczyk
(74) *Attorney, Agent, or Firm* — Holzer Patel Drennan

(57) ABSTRACT

A sanitary oral interface for an inhaling article is provided. The sanitary oral interface includes a base couplable to the inhaling article including an exterior surface and a layered sanitary portion coupled about the exterior surface of the base, the layered sanitary portion including a plurality of separable sections layered in a spiral configuration around the base, each separable section being connected to another in series by a series connection interface.

16 Claims, 7 Drawing Sheets

SANITARY ORAL INTERFACE

CROSS-REFERENCE TO RELATED APPLICATIONS

This application claims a benefit of priority to U.S. Provisional Patent Application No. 63/256,333, entitled "Sanitary Oral Interface," and filed on Dec. 13, 2021, which is specifically incorporated by reference for all that it discloses and teaches.

BACKGROUND

It is a common practice to share inhaling articles, such as cigarettes, cigars, pipes, and vaporizers. The sharing may involve the exchange of oral fluids, which can cause the transmission of communicable maladies. The inhaling articles are often composed of liquid-absorbent materials and do not present any barriers to the transmission of communicable maladies.

SUMMARY

The described technology provides implementations of a sanitary oral interface for an inhaling article. The sanitary oral interface includes a base couplable to the inhaling article, including an exterior surface and a layered sanitary portion coupled about the exterior surface of the base. The layered sanitary portion includes a plurality of separable sections layered in a spiral configuration around the base, each separable section being connected to another in series by a series connection interface.

This summary is provided to introduce a selection of concepts in a simplified form that is further described below in the Detailed Description. This summary is not intended to identify key features or essential features of the claimed subject matter, nor is it intended to be used to limit the scope of the claimed subject matter.

Other implementations are also described and recited herein.

DETAILED DESCRIPTION

It is a common practice to share inhaling articles, and this can present a significant risk to those sharing the inhaling articles. For example, at public events, sharing of inhaling articles is a common social activity, but sharing inhaling articles is risky. Inhaling articles may include smoking or vaporizing articles (e.g., for smoking or vaporizing tobacco or other smokable or vaporizable substances) or inhalers.

Orally engaging a surface that was previously orally engaged by a different user risks exposure to microbial or other potentially deleterious elements present in the mouth of the different user. Further, potential solutions may be costly to manufacture or may be inconvenient in practice.

The presently disclosed technology provides a sanitary oral interface that can be attached to or be an integral element of existing inhaling articles. In implementations, the sanitary oral interface includes a layered sanitary portion with decouplable sections. The decouplable sections are removable to expose a previously unexposed section when a section is decoupled. The unexposed section may provide a new inhaling interface surface to prevent interaction between the mouth of a subsequent user and the oral fluids of a prior user. In so doing, the risk of transmitting communicable maladies is significantly reduced.

Figure 1:
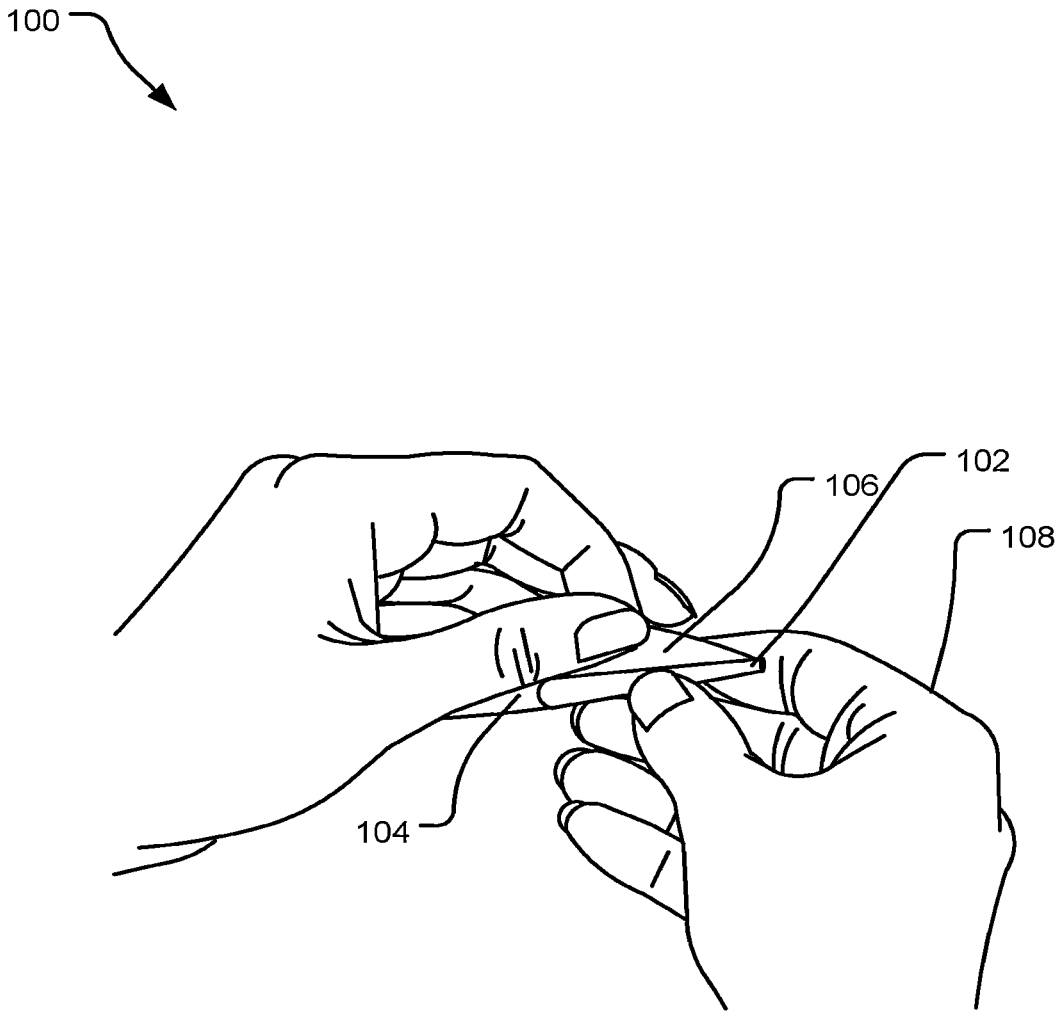
FIG. 1 illustrates an example of a sanitary oral interface system.

FIG. 1 illustrates an example of a sanitary oral interface system 100. In the sanitary oral interface system 100, a user 108 is about to smoke a cigarette 104 that was passed to the user 108 after a different user previously orally engaged the cigarette 104. In the illustrated implementation, the cigarette 104 includes the sanitary oral interface 102 at a proximal portion of the cigarette 104. The sanitary oral interface 102 provides a removable section 106 that allows the user 108 to remove the removable section 106 of the sanitary oral interface 102 adapted to be orally engaged by the user 108. The removal eliminates or mitigates the transfer of orally transmissible maladies between the user 108 and the prior user.

In implementations, the sanitary oral interface 102 includes a layered sanitary portion. In an implementation, the layered sanitary portion includes a plurality of removable sections. Each of the plurality of removable sections is coupled to at least another of the plurality of removable sections by a series coupling and/or a radial coupling. The layered sanitary portion is at least partially composed of a sanitary material that is liquid-resistant and/or antimicrobial. For example, each section may include a radially external (or lateral) surface that includes a sanitary material. In another implementation, each section may be entirely composed of a sanitary material, or all of the surfaces of each section may be covered with a sanitary material. Examples of sanitary materials include polylactic acid (PLA) or polyethylene (PE). PLA can be made organically.

In an implementation, the layered sanitary portion is composed of a single sheet that is subsequently weakened (e.g., by perforations configured to assist decoupling or by a thinning of the material of the sheet) at a number of positions to provide a plurality of separable sections that are series decouplable from one another. Each of the plurality of separable sections may be separably coupled to another of the plurality of separable sections in series by series connection interfaces. Each series connection interface may include a weakened or weak portion (e.g., a perforation or a thinning of material). The weakened portion may be adapted to require less force to decouple a series coupling between separable sections than to tear, damage, or otherwise compromise the interior (unweakened portion) of the separable sections. The weakened portion may further include a sanitary coating that is liquid-resistant and/or antimicrobial.

The single sheet may be wrapped around a base (e.g., the base being composed of material more rigid than that of the single sheet). The wrapping may be strategic such that an interior section around which an exterior section is wrapped may be circumferentially covered by the exterior section (e.g., at least at a proximal portion of the interior section or completely). This covering may allow each section of the sanitary oral interface 102 to interface with the mouth of only one user, providing a new, fresh oral interface surface of a section for each user until the sections are depleted, or the inhaling article is exhausted.

The layered sanitary portion may include radial coupling portions between layers that facilitate radial adhesion between the surfaces of each separable section. For example, one or more separable sections may include a radial coupling portion, the radial coupling portion radially coupling a lateral surface of a separable section to a medial surface of the separable section that is lateral relative to the lateral surface. In implementations, the series connection interface is arranged relative to the radial coupling portion such that the series connection interface of a next-in-series separable section (that is located radially interior or medially) is at least partially covered by the separable section until the radial coupling of the radial coupling portion is decoupled. The radial coupling portion may be adapted to require less force to sever the radial coupling of the radial coupling portion than to damage the separable section. In an implementation, the base is composed of a material that is more rigid than the material of which the layered sanitary portion is composed.

One or more of the separable sections may include a removal member (e.g., a grip or tab). The removal member may be radially uncoupled to any separable section of the plurality of separable sections radially internal relative to the removal member. The removal member of an interior separable section may be at least partially exposed by the removal of an external separable section of the plurality of separable sections radially external to the removal member. The removal member may be at least partially defined by the series connection interface. For example, in implementations in which the series connection interface includes a perforation or weakened portion, the perforation or weakened portion may be of a predefined shape such that series decoupling the weakened portion may form the removal member.

In implementations, the base may be integrated as an element of the inhaling article. In other implementations, an inhaling article interface of the base may be adapted to couple the base with the inhaling article (e.g., the cigarette 104). For example, the inhaling article interface may include a conformal portion that is adapted to conform to a predefined conformal portion of the inhaling article.

As described herein, a proximal direction is a direction from which a user's mouth engages the sanitary oral interface 102, and a distal direction is a direction from which inhaling article (e.g., the cigarette 104) is coupled to the sanitary oral interface 102 (e.g., via a base).

Figure 2:
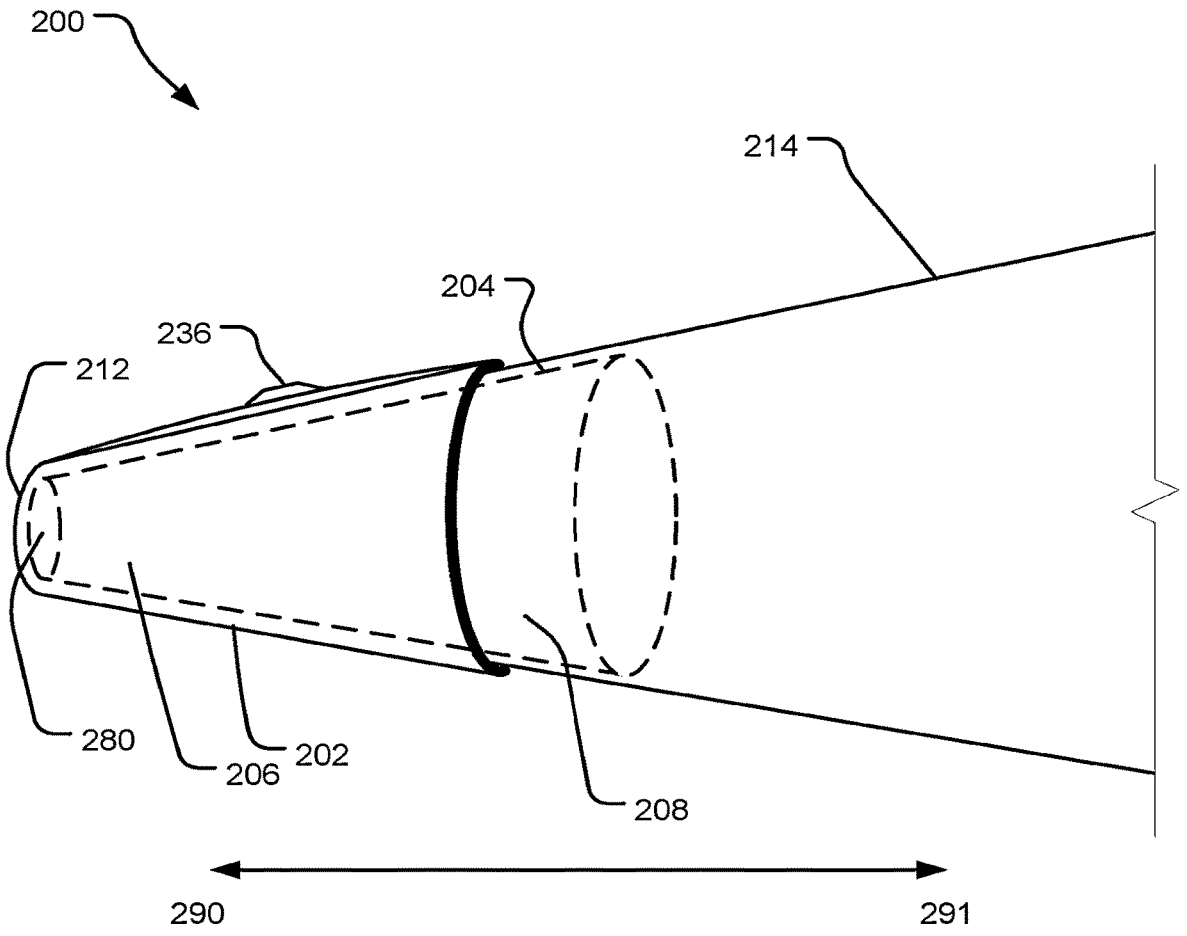
FIG. 2 illustrates another example of a sanitary oral interface system.

FIG. 2 illustrates an example of a sanitary oral interface system 200. The illustrated implementation of the sanitary oral interface system 200 includes a layered sanitary portion 202 coupled to a base 204. The layered sanitary portion 202 is coupled about a perimeter or circumference of a proximal and/or external surface 206 of the base 204. An inhaling article interface 208 (e.g., a distal inhaling article interface portion) of the base 204 may be coupled to (e.g., integral to) or couplable with a proximal portion of an inhaling article 214. For reference, a proximal direction 290 and a distal direction 291 are illustrated. For purposes of illustration, the proximal portion 212 of the layered sanitary portion 202 is the portion adapted for a user to orally engage the layered sanitary portion 202. The inhaling article 214 may include, without limitation, a cigarette, a cigar, a pipe, a vaporizer, an inhaler, a mask, a compressed gas dispensing system, or the like.

While all are illustrated as frustoconical, one or more of the layered sanitary portion 202, the base 204, and the inhaling article 214 may be of the same or different shapes. Potential shapes for the layered sanitary portion 202, the base 204, or the inhaling article 214 may include cylindrical, polygonal, prismatic, spherical, and any other conceivable three-dimensional shape. The shape of these elements may at least partially conform with the inhaling article 214, the base 204, or the layered sanitary portion 202. Implementations of the base 204 may include adapters to couple the layered sanitary portion 202 of a first internal and/or external shape to the inhaling article 214 of a different internal and/or external shape. Further, the layered sanitary portion 202, the base 204, or the inhaling article 214 may include the fluid passageway 280 through which gas (e.g., air, smoke, and/or vapor) may travel and be inhaled by a user. The base 204 may include a fluid passageway 280 (e.g., a cannula, channel, filter, or porous element defined by the material of the base). The inhaling article 214 may apply heat or have heat applied to the inhaling article 214 to cause combustion or vaporization of inhalable gases that may travel through the fluid passageway 280 to be inhaled through the layered sanitary portion 202.

In various implementations, the base 204 may be completely covered by one or more of the layered sanitary portion 202 and the inhaling article 214. Alternatively, the base 204 may receive a conformal proximal portion of the inhaling article 214 in the interior of the base 204 for coupling. The base 204 may have complementary conformal elements that conform to conformal elements of the inhaling article 214 to couple the base 204 with the inhaling article 214.

The layered sanitary portion 202 may include materials that are liquid-resistant, fluid resistant, and/or antimicrobial. For example, in an implementation, a lateral surface (and/or a medial surface) of each separable section of the layered sanitary portion 202 may include a sanitary coating (e.g., over paper or a different substrate) that is liquid-resistant, fluid-resistant, and/or antimicrobial. In another implementation, each separable section of the layered sanitary portion 202 is composed of or coated by a sanitary material that is liquid-resistant, fluid-resistant, and/or antimicrobial The layered sanitary portion 202 may include a plurality of separable sections (the exterior most of which is illustrated on the exterior of the layered sanitary portion 202). The separable sections may overlap and/or be arranged to present a new surface to each user when a section of the layered sanitary portion 202 is removed. As illustrated, the exterior most separable section includes a removal member 236 (e.g., a tab or grip) to facilitate the removal of the exterior most separable section. The plurality of separable sections may be wrapped around each other to provide sanitary surfaces for the layered sanitary portion 202.

In the illustrated implementation, the layered sanitary portion 202 extends further distally from the base 204 than the inhaling article 214 (e.g., because the plurality of separable sections of the layered sanitary portion 202 are thicker than the exterior or paper of the inhaling article 214). Implementations are contemplated in which the inhaling article interface 208 extends less distally (e.g., has a smaller circumference) relative to the proximal portion 204 to mitigate or reduce this disparity in distal thickness of the sanitary oral interface system 200.

In an implementation, the separable sections of the layered sanitary portion 202 are formed to generate a distal-medial slope at the proximal portion 212. The distal-medial slope can prevent exposure of proximal ends of each of the separable sections to more than one user. For example, the proximal end of a first separable section that is distally positioned (e.g., wrapped around) relative to a second separable section will extend further proximally than the proximal end of the second separable section, thereby preventing exposure of the distal end of the second separable section when the first separable section is orally engaged by a user. In an implementation, each separable section further includes a proximal lip that extends medially at the proximal end of each of the separable sections. Implementations are further contemplated in which the lip further extends distally to completely cover the more medial separable sections (e.g., cover the proximal ends or lips of the medial separable sections. The lips may further extend to cover and prevent exposure of the proximal end of the base. The lips can further ensure that a user only orally engages one separable section at a time.

Figure 3:
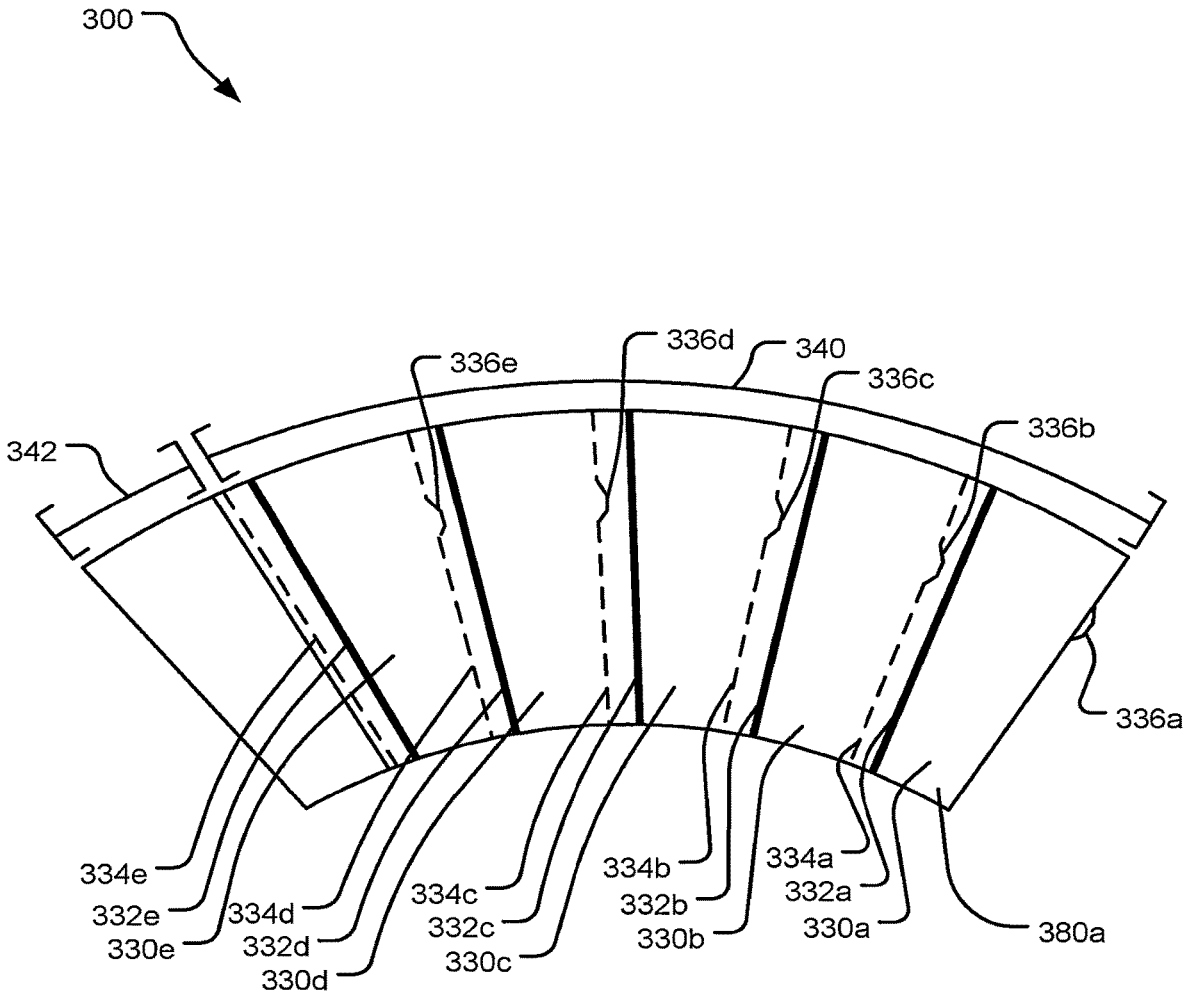
FIG. 3 illustrates an unwrapped view of an example of a layered sanitary portion.

FIG. 3 illustrates an unwrapped view of an example of a layered sanitary portion 300. The unwrapped view may represent the layered sanitary portion 300 in an unrolled or unraveled state. The layered sanitary portion 300 includes a peelable portion 340 and a base coupling portion 342. The base coupling portion 342 may be coupled on a radially interior (or medial) surface with a base (or may serve as a base itself). The peelable portion 340 may include separable sections 330*a-e*. The peelable portion 340 may be at least partially composed of a sanitary material that is antimicrobial and/or liquid resistant. For example, the peelable portion 340 may be entirely composed of or may be coated on at least a radially exterior (lateral) surface of the peelable portion 340 by a sanitary material that is antimicrobial, fluid-resistant, and/or liquid-resistant. Including sanitary materials in the peelable portion 340 may prevent communication of oral fluids between separable sections 330*a-e* of the peelable portion. The peelable portion 340 may be at least partially composed of paper (e.g., paper coated with a sanitary material on at least one side) and/or may be at least partially composed of a polymeric or metallic material. Liquid or fluid-resistant materials, as described herein, refer to materials that substantially prevent absorption of fluid or liquid or substantially prevent fluid or liquid from penetrating from one side of the material to another side of the material. In an implementation, the sanitary material is more resistant to damage or tearing than a material of the layered sanitary portion 300 that the sanitary material coats.

The separable sections 330*a-e* may be coupled in series by series connection interfaces 334*a-e*. The series connection interfaces 334*a-e* may include a weakened portion. An implementation of the weakened portion includes one or more perforations. Another implementation of the weakened portion includes a thinned portion of the material of the separable section, including material thinner than at an interior portion of the separable section (e.g., at a first interior portion 380*a*). In an implementation, the weakened portion is adapted to decouple using less force that would damage interior portions (e.g., the first interior portion 380*a*) of the separable sections 330*a-e*. The series connection interfaces 334*a-e* may be adapted to require less force to decouple the separation portions than to damage interior portions (e.g., the first interior portion 380*a*) of the separable sections 330*a-e*. The series connection interfaces can be modified based on one or more of the materials of which the layered sanitary portion is composed and the nature of the series connection interface to facilitate this relationship of responses to applied forces.

In an implementation, the layered sanitary portion 300 includes a plurality of separable sections, including the separable sections 330*a-e*. The separable sections 330*a-e* may be layered in a spiral configuration (e.g., spirally wound) about a base (e.g., an external or distal surface of the base). For example, an external separable section 330*a* may be spirally wound around and/or circumferentially surround internal separable sections 330*b-e*. This winding may allow only one of the separable sections 330*a-e* (e.g., the external separable section 330*a*) to be laterally exposed at any given time. In so doing, the layered sanitary portion 300 only exposes one of the separable sections 330*a-e* to a mouth of a user for oral engagement at any time. It should be appreciated that the winding may be clockwise or counterclockwise relative to a proximal portion of the base.

The external separable section 330*a* and a fourth internal separable section 330*e* (e.g., the separable section series coupled to the base coupling portion 342) may be series coupled to only one other separable section (e.g., the first internal separable section 330*b* and the third internal separable section 330*d*, respectively). The external separable section 330*a* (e.g., the section positioned most radially outward or most laterally) may be only series coupled on one side to a first internal separable section 330*b*. The fourth internal separable section 330*e* may be series coupled on one side to the third internal separable section 330*d* and to the base coupling portion 342. The internal separable sections 330*b-d* may each be series coupled to two separable sections 330*a-e*.

Each separable section 330*a-e* may include a radial coupling portion 332*a-e* to radially couple a portion of a separable section 330*a-e* to another portion of the separable section 330*a-e*. The radial coupling portions 332*a-e* may include an adhesive. The adhesive may be non-toxic and/or safe for consumption (e.g., Arabic gum), as a user may be expected to engage her mouth with residue from the radial coupling portions 332*a-e*. The radial coupling portions 332*a-e* may radially couple an interior radially external (or lateral) surface of a separable section 330*a-e* with a radially internal (or medial) surface of the separable section 330*a-e* that is radially external (or lateral) relative to the radially external (or lateral) surface (when the separable section is laterally coupled to and wrapped around itself). In an implementation, the radial coupling portions 332*a-e* are adapted to require less force to sever or decouple the radial coupling of the radial coupling portions 332*a-e* than to damage the interior portions (e.g., the first interior portion 380*a*) of the separable sections 330*a-e*.

Different strengths of the radial coupling portions 332*a-e* relative to the series connection interfaces 334*a-e*. For example, the radial coupling portions 332*a-e* may be more strongly adherent or less strongly adherent than the series connection interfaces 334*a-e*. Alternatively or additionally, the radial coupling portions 332*a-e* and the series connection interfaces 334*a-e* may respond differently to force applied in different directions. For example, the radial coupling portions 332*a-e* may be less resistant to radial decoupling forces and/or more resistant to series decoupling forces (e.g., forces applied in a spiral outward direction or applied tangentially to the series connection interfaces 334*a-e*) than the series connection interfaces 334*a-e*. These different responses to applied forces may be facilitated by structures such as the weakened portions of the series connection interfaces 334*a-e*, the radial direction of the radial coupling portions 332*a-e*, and/or removal members 336*a-e*.

In an implementation, the separable sections 330*a-e*, series connection interfaces 334*a-e*, and the radial coupling portions 332*a-e* may be arranged such that each separable section 330*a-e* completely covers the next separable section in series when wrapped. In implementations, if the external separable section 330*a* is removed, a first internal separable section 330*b* that is immediately radially interior (or medial) relative to the external separable section 330*a* may be exposed and cover a whole exterior perimeter of the layered sanitary portion (until the fourth internal separable section 330*e* is removed if it is removable).

In an implementation, each separable section 330*a-e* may also include a removal member 336*a-e*. Examples of removal members 336*a-e* may include, without limitation, spirally outward protrusions of the separable sections 330*a-e* (e.g., defined by the series connection interfaces 334*a-e* and/or weakened portions thereof), a tab, a grip, or added reinforcing material. The removal members 366*a-e* may be coupled to or integral to a spirally outward edge of each of the separable sections 330*a-e*. The removal members 336*a-e* may be composed of the same material as or a different material from the separable sections 330*a-e*. For example, the removal members 336*a-e* may be composed of a material that is stronger or more rigid than the materials of which the separable sections 330*a-e* are composed. The removal members 336*a-e* may be arranged between proximal and distal ends of the separable section, such that the external removal member 336*a* of the external separable section 330*a* is the only removal member 336*a-e* completely exposed. A user may apply force to the external removal member 336*a* to remove the external separable section 330*a*. The removal members 336*a-e* may be elements of the series connection interfaces 334*a-e* or may be positioned above portions of the separation portions 334*a-e*.

Implementations are contemplated in which the removal members 336*a-e* are integrated into the series connection interfaces 333*a-e* but are further reinforced by a coating more rigid or tear-resistant than the interior portions of the separable sections 330*a-e*. In implementations, the removal members 336*b-e* of the internal separable sections 330*b-e* are positioned spirally inwardly relative to a radial coupling portion 332*b-d* of an immediately spirally inward one of the separable sections 330*a-e*.

Implementations are contemplated in which the second removal member coupled to the first internal separable section 330*b* is covered by a first overlapped portion of the external separable section 330*a* when the separable sections 330*a-e* are wound. The first overlapped portion is a portion of the external separable section 330*a* covered between a portion of the distal surface of the external separable section at which the first radial coupling portion 332*a* is coupled and the first series connection interface 334*a*. For example, the external separable section 330*a* may include a first radial coupling portion 332*a*. The first radial coupling portion 332*a* radially couples a lateral surface of the external separable section 330*a* to a medial surface of the external separable section 330*a*. The medial surface is positioned laterally relative to the lateral surface, and the first radial coupling portion 332*a* is positioned at an interior portion of the external separable section 330*a*, causing a spirally outward portion of the external separable section 330*a* to overlap with a spirally inward portion of the external separable section 330*a*. The overlapped portion is not exposed to a user's mouth when a user orally engages the external separable section 330*a* prior to the decoupling of the first radial coupling portion 332*a*. In implementations, the removal members 336*a-e* are each directly coupled to or integral with only one of the separable sections are not directly radially coupled (e.g., directly radially uncoupled) to separable sections other than one of the separable sections 330*a-e* to which or with which the removal members 336*a-e* are coupled or integral.

In the illustrated implementation, the layered sanitary portion 300 includes the external separable section 330*a*, internal separable sections, and a fourth internal separable section 330*e*. A first radial coupling portion 332*a* radially couples the external separable section 330*a* radially with itself (e.g., an external surface of the external separable section 330*a* is radially coupled with an internal surface of the external separable section 330*a* located laterally relative to the external surface). The external separable section 330*a* includes the external removal member 336*a*. A first series connection interface 334*a* couples the external separable section in series with a first internal separable section 330*b*. A second radial coupling portion 332*b* couples the first internal separable section 330*b* with itself. The first internal separable section 330*b* includes a second removal member 336*b*. A second series connection interface 334*b* couples the first internal separable section 330*b* in series with a second internal separable section 330*c*. A third radial coupling portion 332*c* couples the second internal separable section 330*c* with itself. The second internal separable section 330*c* includes a third removal member 336*c*. A third series connection interface 334*c* couples the second internal separable section 330*c* in series with a third internal separable section 330*d*. A fourth radial coupling portion 332*d* couples the third internal separable section 330*d* with itself. The third internal separable section 330*d* includes a fourth removal member 336*d*. A fourth series connection interface 334*d* couples the third internal separable section 330*d* in series with a fourth internal separable section 330*e*. A fifth radial coupling portion 332*e* couples the fourth internal separable section 330*e* with itself. The fourth internal separable section 330*e* includes a fifth removal member 336*e*. A fifth series connection interface 334*e* couples the fourth internal separable section 330*e* in series with the base coupling portion 342.

Figure 4:
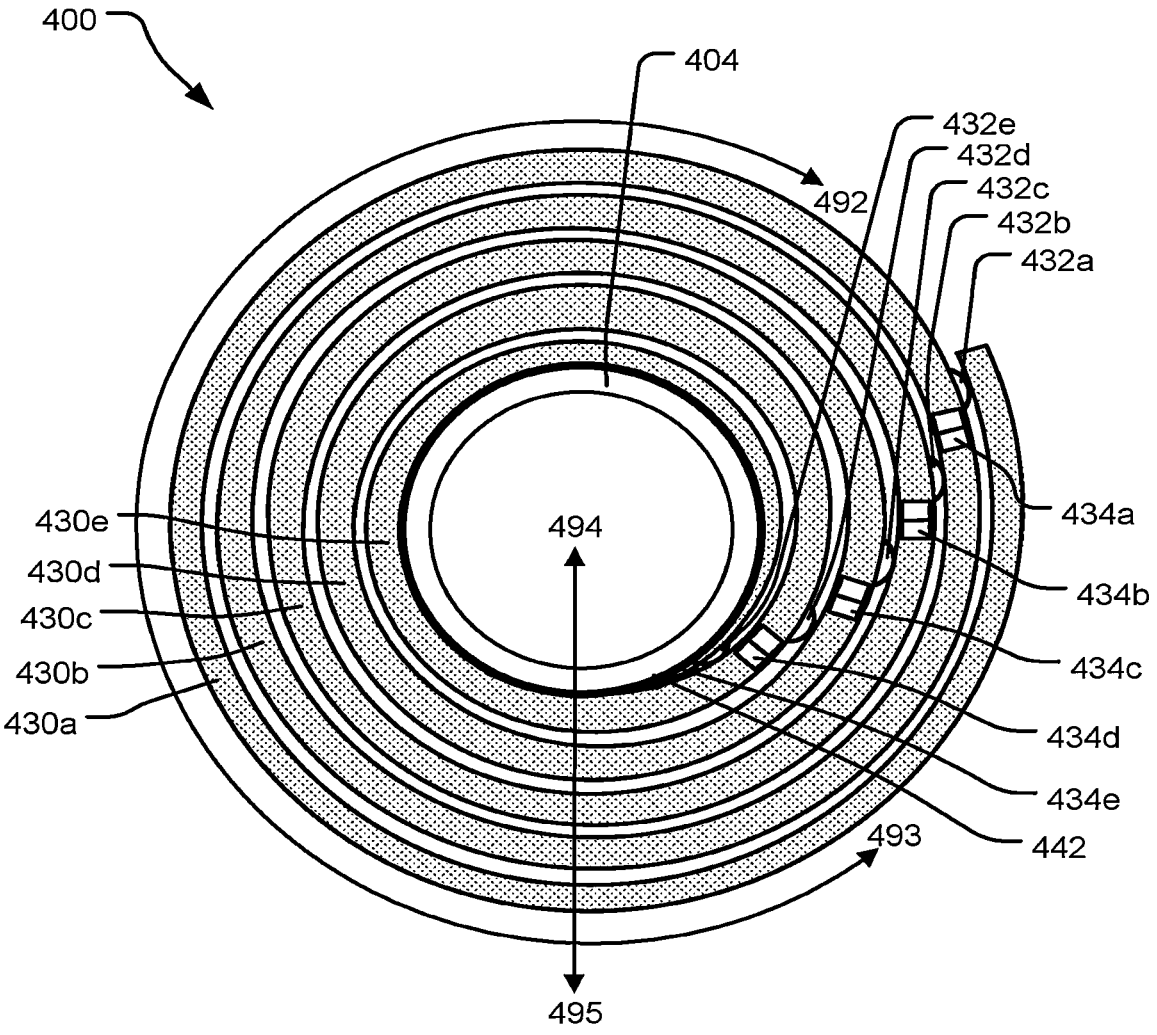
FIG. 4 illustrates a wrapped view of an example of a layered sanitary portion.

FIG. 4 illustrates a wrapped view of an example of a layered sanitary portion 400. The wrapped view may represent the layered sanitary portion 400 in a rolled or wrapped state. It should be appreciated that the scale of the illustrated FIG. 4 may be exaggerated for purposes of demonstration. For example, the layered sanitary portion 400 and its separable sections 430*a-e* may be composed of a paper or other thin material that is considerably thinner relative to a radial width or radius of the layered sanitary portion. Further, the radial coupling portions 432*a-e* show radial couplings projecting significantly from the separable sections 430*a-e* when it may, in implementations, be substantially flush with the surfaces of the separable sections 430*a-e*. In implementations, the radial coupling portions 432*a-e* extend from the proximal end to the terminal end of the separable sections 430*a-e*, respectively.

For purposes of reference, a radially inward or internal (or medial) direction 494 and a radially outward or external (or lateral) direction 495 are illustrated. Further, an inward spiral direction 492 (e.g., a spiral inward direction or inward winding direction) and an outward spiral direction 493 (e.g., a spiral outward or outward winding direction) are illustrated. The inward spiral direction 492 spirals inwardly along series couplings 434*a-e* of the separable portions 430*a-e* to a base 404 or base coupling portion (e.g., from radially external (or lateral) separable sections 430*a-d* to radially internal (or medial) separable sections 430*b-e*). The outward spiral direction 493 spirals outwardly along series couplings 434*a-e* of the separable portions 434*a-e* to a radially exterior surface of the layered sanitary portion 400

(e.g., from radially internal (or medial) separable sections 430*a-d* to radially external (or lateral) separable sections 430*b-e*).

An external separable section 430*a* may be radially coupled to itself by a first radial coupling portion 432*a*. As illustrated, the first radial coupling portion 432*a* radially couples a radially exterior (lateral) surface of the external separable section 430*a* to a radially interior (medial) surface of the external separable section 430*a* that is radially external (lateral) relative to the radially exterior (lateral) surface. Further, the radially exterior (lateral) surface may be positioned in an inward spiral direction 492 relative to the radially interior (medial) surface. Radially exterior (lateral) surfaces of the separable sections 430*a-e* may be the surfaces that are exposed for a user to orally engage the layered sanitary portion 400.

The external separable section 430*a* may be series coupled to a first internal separable section 430*b* that is radially internal (medial) of the external separable section 430*a* (e.g., by the external separable section 430*a* being wrapped around the first internal separable section 430*b*) by a first series connection interface 434*a*. The first radial coupling portion 432*a* may be positioned on the radially exterior surface of the external separable section 430*a*, which is positioned in an outward spiral direction 493 from the first series connection interface 434*a* between the external separable section 430*a* and the first internal separable section 430*b*. A second radial coupling portion 432*b* radially couples a radially exterior (lateral) surface of the first internal separable section 430*b* to a radially interior (medial) surface of the first internal separable section 430*b* that is radially external (lateral) relative to the radially exterior (lateral) surface of the first internal separable section 430*b*. The first radial coupling portion 432*a* may be positioned in an outward spiral direction 493 relative to the first series connection interface 434*a* between the external separable section 430*a* and the first internal separable section 430*b*.

In implementations where the layered sanitary portion 400 is composed of a single sheet (in which the separable sections are defined), there may be a repeating pattern with respect to the internal separable sections 430*b-d* of a radially exterior (lateral) surface of the external separable section 430*a* being coupled with the first radial coupling portion 432*a*, then, spiral inwardly in the inward spiral direction 492, the first series connection interface 434*a*, and then, further spiral inward in the inward spiral direction 492, a radially internal (medial) surface of the first internal separable section 430*b*.

In implementations, the layered sanitary portion 400 may have overlapped portions to ensure that each separable section presents a completely sanitary perimeter of the layered sanitary portion 400 when an exposed separable section is removed. For example, the portion of the external separable section 430*a* between the first radial coupling portion 432*a* and the portion of the external separable section 430*a* immediately radially external (lateral) of the external separable section 430*a* may represent an overlapped portion. Further, if the external separable section 430*a* is removed, another overlapped portion may be defined as between the second radial coupling portion 432*b* and the portion of the first internal separable section 430*b* immediately radially external (lateral) of a second series connection interface 434*b*. The fourth internal separable section 430*e* may be coupled in series to a base 404 or base coupling portion. In an implementation, the radial decoupling of the first radial coupling portion 432*a* (and peeling away or unrolling of the external separable section 430*a*) may expose the first series connection interface 434*a*. The exposure may help facilitate the series decoupling of the first series connection interface 434*a* and the subsequent removal of the external separable section 430*a*.

In the illustrated implementation, the layered sanitary portion 400 includes the external separable section 430*a*, internal separable sections, and a fourth internal separable section 430*e*. A first radial coupling portion 432*a* radially couples the external separable section 430*a* radially with itself (e.g., an external surface of the external separable section 430*a* is radially coupled with an internal surface of the external separable section 430*a* located laterally relative to the external surface). The external separable section 430*a* includes the external removal member (not illustrated). The first series connection interface 434*a* couples the external separable section in series with a first internal separable section 430*b*. A second radial coupling portion 432*b* couples the first internal separable section 430*b* with itself. The first internal separable section 430*b* includes a second removal member (not illustrated). The second series connection interface 434*b* couples the first internal separable section 430*b* in series with a second internal separable section 430*c*. A third radial coupling portion 432*c* couples the second internal separable section 430*c* with itself. The second internal separable section 430*c* includes a third removal member (not illustrated). A third series connection interface 434*c* couples the second internal separable section 430*c* in series with a third internal separable section 430*d*. A fourth radial coupling portion 432*d* couples the third internal separable section 430*d* with itself. The third internal separable section 430*d* includes a fourth removal member (not illustrated). A fourth series connection interface 434*d* couples the third internal separable section 430*d* in series with a fourth internal separable section 430*e*. A fifth radial coupling portion 432*e* couples the fourth internal separable section 430*e* with itself. The fourth internal separable section 430*e* includes a fifth removal member (not illustrated). A fifth series connection interface 434*e* couples the fourth internal separable section 430*e* in series with the base coupling portion 442.

Figure 5:
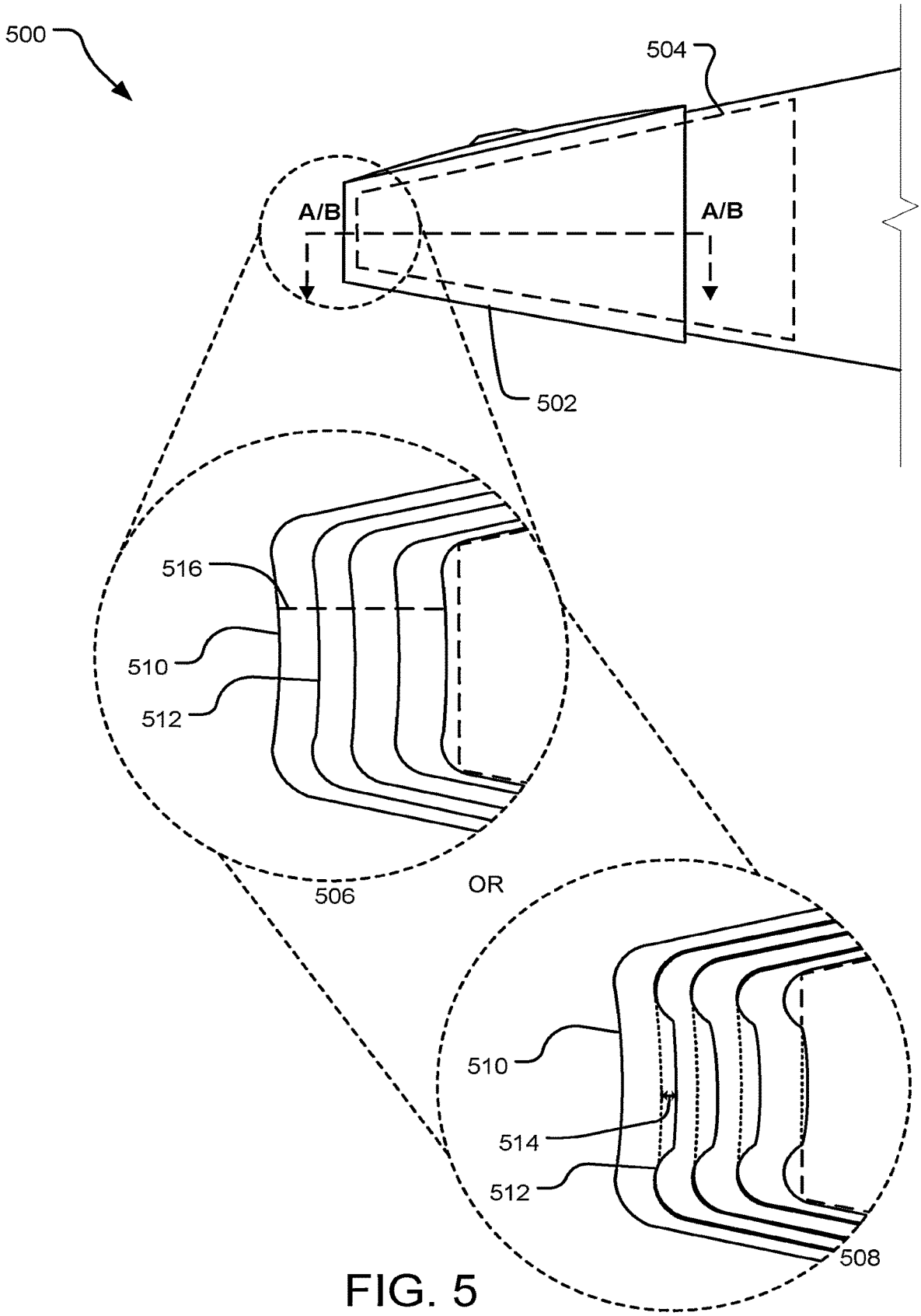
FIG. 5 illustrates an example of a sanitary oral interface system.

FIG. 5 illustrates still another example of a sanitary oral interface system 500. The sanitary oral interface system 500 includes a layered sanitary portion 502 and a base 504. The layered sanitary portion 502 is coupled medially to the base 504. Cross-sectional views of a first proximal end implementation 506 and a second proximal end implementation 508 are presented as alternative design choices for the sanitary oral interface system 500. The cross-sectional views represent a bisected view of layered sanitary portion 502 and the base 504.

In the first proximal end implementation 506, radially lateral (external) separable sections extend further proximally than radially medial (internal) separable sections. By way of example, an external separable section 510 extends further proximally (e.g., further towards a proximal end of the sanitary oral interface system 500 adapted for a user to engage orally) than an internal separable section 512. In this implementation, the external separable section 510 at least partially covers the internal separable section 512. In the illustrated implementation, the separable sections extend further proximally than the base 504. The separable sections also extend further proximally than the base 504. The separable sections of the layered sanitary portion are formed to generate a distal-medial slope 516. The distal-medial slope 516 can prevent exposure of proximal ends of each of the separable sections to more than one user.

In the second proximal end implementation 508, the external separable section 510 extends further proximally, then further extends medially, and then further extends distally to form a lip that includes an overlapping portion 514 that at least a portion of the proximal portion (e.g., a lip of) the internal separable section 512. In the illustrated implementation, the lips of the separable sections also cover a proximal end of the base 504, preventing a user from orally engaging the base 504.

Figure 6:
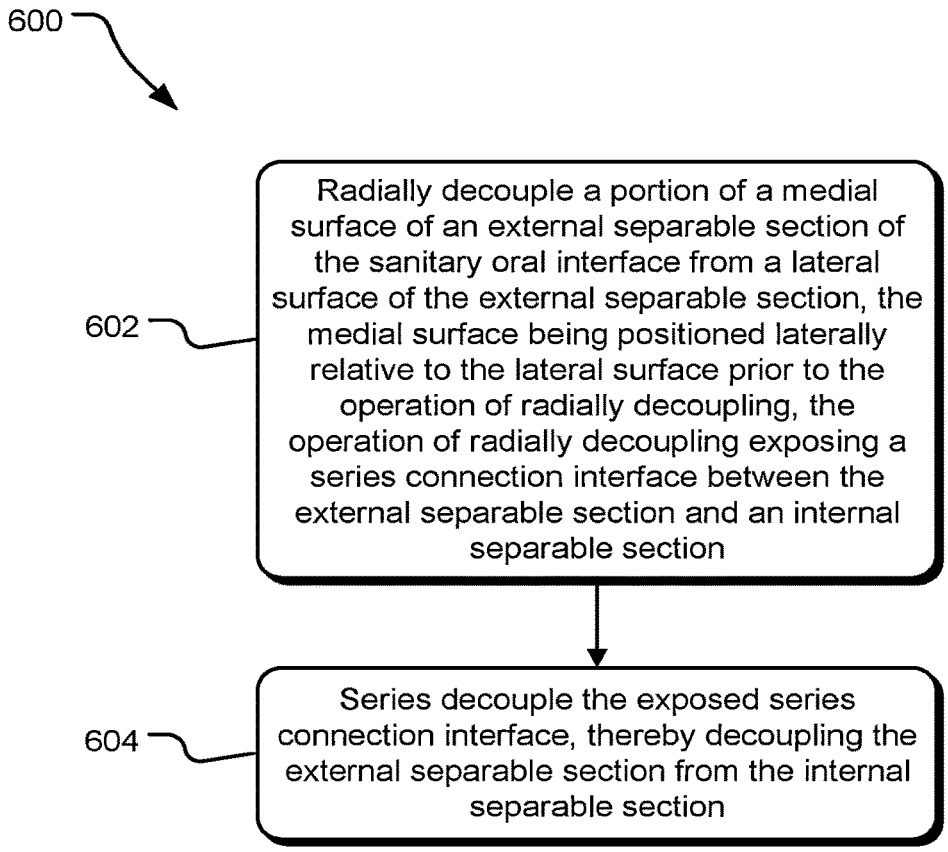
FIG. 6 illustrates example operations of using a sanitary oral interface.

FIG. 6 illustrates example operations 600 of using a sanitary oral interface. A radial decoupling operation 602 radially decouples a portion of a medial surface of an external separable section of the sanitary oral interface from a lateral surface of the external separable section. In an implementation, the medial surface is positioned laterally relative to the lateral surface prior to the operation of radially decoupling. The operation of radially decoupling may expose a series connection interface between the external separable section and an internal separable section. The radial decoupling operation 602 may allow the external separable section to be peeled away or unrolled from the rest of the layered sanitary portion. The peeling away may remove an overlapped portion as described herein. In an implementation, the external separable section includes a removal member to help grip the external separable section to radially decouple the external section.

A series decoupling operation 604 series decouples the exposed series connection interface, thereby decoupling the external separable section from the internal separable section. The series decoupling operation 604 may facilitate the removal of the external separable section from the layered sanitary portion. This removal may expose a radially exterior (lateral) surface of a second separable section (making the formerly internal separable section an external separable section). Further, in implementations where removal members are positioned between a spiral inward side and a spiral outward side of a separable section, the removal of the external separable section may expose a removal member of the second separable section.

In implementations in which a separable section includes a removal member, a user may engage the removal member to conduct the radial decoupling operation 602 and/or the series decoupling operation 604.

Figure 7:
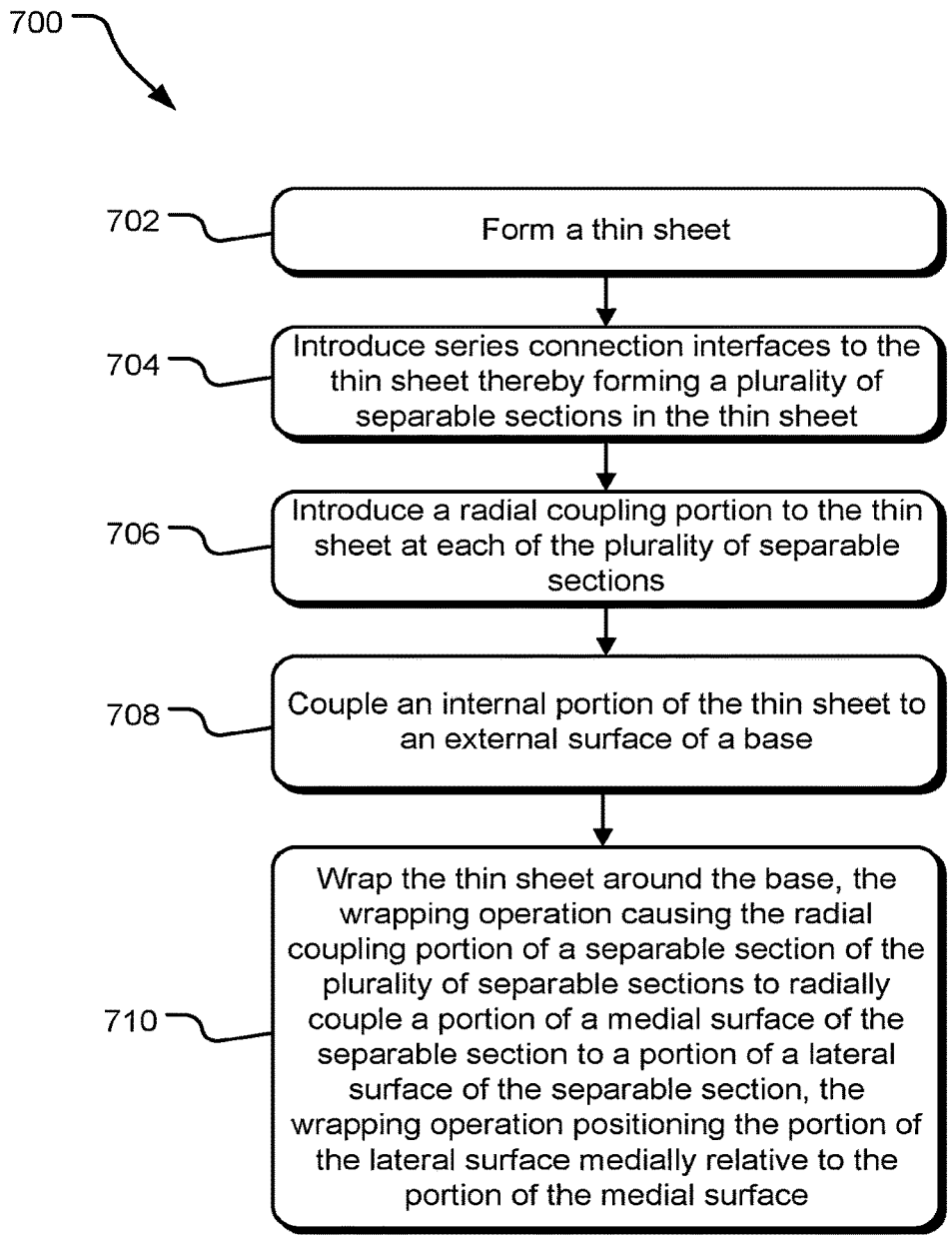
FIG. 7 illustrates example operations of making a sanitary oral interface.

FIG. 7 illustrates example operations 700 of making a sanitary oral interface. Forming operation 702 forms a thin sheet. Introducing operation 704 introduces series separation interfaces to the thin sheet, thereby forming a plurality of separable sections in the thin sheet. In an implementation, the introducing operation 704 causes the formation of the series connection interfaces with integrated separation members (e.g., where separation members are defined by perforations in the series connection interfaces). In another implementation, a further introducing operation (not illustrated) introduces the removal members to one or more of the separable sections. For example, extra material may be added to radial outward edges of the separable sections or tabs may be attached to the radial outward edges. The material or tabs used for the removal members may be more rigid than the separable sections. Further, the removal members may be more strongly adherent to the separable sections than the series separation interfaces or radial coupling portions. In other implementations, the removal members are omitted.

Introducing operation 706 introduces a radial coupling portion to the thin sheet at each of the plurality of separable sections. The introducing operation 704 and the introducing operation 706 may be performed in any order. Coupling operation 708 couples an internal portion of the thin sheet to an external surface of a base. Wrapping operation 710 wraps the thin sheet around the base. The wrapping operation 710 may cause the radial coupling portion of a separable section to couple a medial surface of the separable section to a lateral surface of the external separable section (e.g., by adhering adhesive). The medial surface may be lateral relative to the lateral surface when coupled.

In implementations, the operations 700 may further include a coupling operation (not illustrated) that couples an inhaling article interface (e.g., a distal inhaling article interface portion) of the base to a portion of the inhaling article.

In an implementation, the operations 700 (e.g., the forming operation 702) further form the separable sections of the layered sanitary portion to generate a distal-medial slope at proximal ends of the separable sections. The distal-medial slope can prevent exposure of proximal ends of each of the separable sections to more than one user. For example, the proximal end of a first separable section that is distally positioned (e.g., wrapped around) relative to a second separable section will extend further proximally than a proximal end of the second separable section, thereby preventing exposure of the distal end of the second separable section when the first separable section is orally engaged by a user. This relative proximal positioning can be conducted during the forming operation 702 (e.g., by forming more lateral separable sections to extend more proximally and/or to be longer from proximal to distal ends that internal or the wrapping operation 710.

In an implementation, the operations 700 further include a folding operation (not illustrated) to fold the separable sections to form a proximal lip that extends medially at the proximal end of each of the separable sections. Implementations are further contemplated in which the lip further extends distally such that each separable section lip completely covers the more medial separable sections (e.g., cover the proximal ends or lips of the medial separable sections). The lips may further extend to cover and prevent exposure of the proximal end of the base. The lips can further ensure that a user only orally engages one separable section at a time. The folding operation may be conducted prior to or after the coupling operation 708 and/or the wrapping operation 710. Implementations are contemplated in which the lips are not included, and the folding operation is omitted.

Operations 600 and/or operations 700 may be conducted by a computing device having a hardware processor and a hardware memory system, the hardware processor for executing one or more operations stored in the hardware memory system. Instructions for conducting the operations 600 and 700 may be stored in non-transitory computer-readable media that may be executable by one or more hardware processors of a computing device.

The logical operations making up implementations of the technology described herein may be referred to variously as operations, steps, objects, or modules. One or more logical operations can be assembled to define a method of making or a method of use. Furthermore, it should be understood that logical operations may be performed in any order, adding or omitting operations as desired, regardless of whether operations are labeled or identified as optional, unless explicitly claimed otherwise or a specific order is inherently necessitated by the claim language.

An example sanitary oral interface for an inhaling article is provided, including a base configured to be coupled to the inhaling article including an exterior surface; and a layered sanitary portion coupled about the exterior surface of the base, the layered sanitary portion including a plurality of separable sections layered in a spiral configuration around the base, each separable section being connected to another in series by a series connection interface.

Another example sanitary oral interface of any disclosed interface is provided, wherein the series connection interface includes a weakened portion, wherein the weakened portion is adapted to decouple using less force than would damage interior portions of the plurality of separable sections.

Another example sanitary oral interface of any disclosed interface is provided, wherein the series connection interface includes a weakened portion, the weakened portion including a perforation.

Another example sanitary oral interface of any disclosed interface is provided, wherein the series connection interface includes a weakened portion, the weakened portion including a material thinner than an interior portion of a separable section.

Another example sanitary oral interface of any disclosed interface is provided, wherein an external separable section of the plurality of separable sections extends further proximally relative to an internal separable section of the plurality of separable sections, the external separable section laterally circumferentially surrounding at least a portion of the internal separable section, the plurality of separable sections forming a distal-medial slope on a proximal end of the sanitary oral interface.

Another example sanitary oral interface of any disclosed interface is provided, wherein an external separable section of the plurality of separable sections includes a radial coupling portion, the radial coupling portion radially coupling a lateral surface of the external separable section to a medial surface of the external separable section, the medial surface positioned laterally relative to the lateral surface.

Another example sanitary oral interface of any disclosed interface is provided, wherein the external separable section includes a radial coupling portion, the radial coupling portion radially coupling a lateral surface of the external separable section to a medial surface of the external separable section, the medial surface positioned laterally relative to the lateral surface, and wherein the radial coupling portion is positioned at an interior portion of the external separable section causing a spirally outward portion of the external separable section to overlap with a spirally inward portion of the external separable section.

Another example sanitary oral interface of any disclosed interface is provided, wherein the external separable section covers internal separable sections of the plurality of separable sections and wherein the radial coupling portion is positioned spirally outwardly relative to the series connection interface coupling the external separable section to one of the internal separable sections.

Another example sanitary oral interface of any disclosed interface is provided, wherein the radial coupling portion is adapted to require less force to sever a radial coupling of the radial coupling portion than to damage the external separable section.

Another example sanitary oral interface of any disclosed interface is provided, wherein at least one of the plurality of separable sections further comprises: a removal member coupled to or integrated with a first separable section of the plurality of separable sections, wherein the removal member is radially uncoupled from other of the plurality of separable sections other than the first separable section.

Another example sanitary oral interface of any disclosed interface is provided, wherein the removal member is at least partially exposed by removal of an external separable section of the plurality of separable sections radially external of the removal member.

Another example sanitary oral interface of any disclosed interface is provided, wherein the removal member is at least partially defined by the series connection interface.

Another example sanitary oral interface of any disclosed interface is provided, wherein the base further comprises: an inhaling article interface adapted to couple the base with the inhaling article.

Another example sanitary oral interface of any disclosed interface is provided, wherein the inhaling article interface includes a conformal portion that is adapted to conform to a predefined conformal portion of the inhaling article.

Another example sanitary oral interface of any disclosed interface is provided, wherein the base is composed of a material that is more rigid than the material of which the plurality of separable sections is composed.

Another example sanitary oral interface of any disclosed interface is provided, wherein the plurality of separable sections is composed of a material that is liquid-resistant or antimicrobial.

Another example sanitary oral interface of any disclosed interface is provided, wherein at least a radially lateral surface of each of the plurality of separable sections includes a material that is liquid-resistant or antimicrobial.

An example method of using a sanitary oral interface for an inhaling article is provided, including radially decoupling a portion of a medial surface of an external separable section of the sanitary oral interface from a lateral surface of the external separable section, the medial surface being positioned laterally relative to the lateral surface prior to the radially decoupling, the radially decoupling exposing a series connection interface between the external separable section and an internal separable section; and series decoupling the exposed series connection interface, thereby decoupling the external separable section from the internal separable section.

An example method of making a sanitary oral interface for an inhaling article is provided, including forming a thin sheet; introducing series connection interfaces to the thin sheet thereby forming a plurality of separable sections in the thin sheet; introducing a radial coupling portion to the thin sheet at each of the plurality of separable sections; coupling an internal portion of the thin sheet to an external surface of a base; and wrapping the thin sheet around the base, the wrapping causing the radial coupling portion of a separable section of the plurality of separable sections to radially couple a portion of a medial surface of the separable section to a portion of a lateral surface of the separable section, the wrapping positioning the portion of the lateral surface medially relative to the portion of the medial surface.

Another example method of any disclosed method is provided, further including coupling an inhaling article interface of the base to a portion of the inhaling article.

An example system of using a sanitary oral interface for an inhaling article is provided, including means for radially decoupling a portion of a medial surface of an external separable section of the sanitary oral interface from a lateral surface of the external separable section, the medial surface being positioned laterally relative to the lateral surface prior to the radially decoupling, the means for radially decoupling exposing a series connection interface between the external separable section and an internal separable section; and means for series decoupling the exposed series connection interface, thereby decoupling the external separable section from the internal separable section.

An example system of making a sanitary oral interface for an inhaling article is provided, including means for forming a thin sheet; means for introducing series connection interfaces to the thin sheet thereby forming a plurality of separable sections in the thin sheet; means for introducing a radial coupling portion to the thin sheet at each of the plurality of separable sections; means for coupling an internal portion of the thin sheet to an external surface of a base; and means for wrapping the thin sheet around the base, the means for wrapping configured to cause the radial coupling portion of a separable section of the plurality of separable sections to radially couple a portion of a medial surface of the separable section to a portion of a lateral surface of the separable section, the means for wrapping positioning the portion of the lateral surface medially relative to the portion of the medial surface.

Another example system of any disclosed system is provided, further including means for coupling an inhaling article interface of the base to a portion of the inhaling article.

An example sanitary oral interface for an inhaling article is provided, including a base; and a layered sanitary portion coupled about an external perimeter of a proximal surface of the base, the layered sanitary portion including a plurality of separable sections, wherein an external separable section of the plurality of separable sections encompasses others of the plurality of separable sections, and wherein each of the plurality of separable sections is separably coupled to another of the plurality of separable sections in series.

Another example sanitary oral interface of any other disclosed interface is provided, wherein the each of the plurality of separable sections is separably coupled to the another of the plurality of separable sections by a series separation portion.

Another example sanitary oral interface of any other disclosed interface is provided, wherein the series separation portion includes a weak portion, wherein the weak portion is adapted to require less force to decouple a series coupling of the separable portion between the each of the plurality of separable sections from the another of the plurality of separable sections than to damage the plurality of separable sections.

Another example sanitary oral interface of any other disclosed interface is provided, wherein the weak portion includes a perforation.

Another example sanitary oral interface of any other disclosed interface is provided, wherein the weak portion includes a thinning of material.

Another example sanitary oral interface of any other disclosed interface is provided, wherein the weak portion includes a sanitary coating that is one or more of liquid resistant and antimicrobial.

Another example sanitary oral interface of any other disclosed interface is provided, wherein the external separable section includes a radial coupling portion, the radial coupling portion radially coupling a lateral surface of the external separable section to a medial surface of the external separable section that is lateral relative to the lateral surface.

Another example sanitary oral interface of any other disclosed interface is provided, wherein an internal separable section is separably coupled in series with the external separable section by the series separation portion, wherein the series separation portion is arranged relative to the radial coupling portion causing the series separation portion to be at least partially covered by the external separable section until the radial coupling portion is decoupled.

Another example sanitary oral interface of any other disclosed interface is provided, wherein the radial coupling portion is adapted to require less force to sever the a radial coupling of the radial coupling portion than to damage the external separable section.

Another example sanitary oral interface of any other disclosed interface is provided, wherein at least one of the plurality of separable sections further comprises: a removal member, wherein the removal member is radially uncoupled from any separable section of the plurality of separable sections.

Another example sanitary oral interface of any other disclosed interface is provided, wherein the removal member is at least partially exposed by removal of the external separable section of the plurality of separable sections radially external of the removal member.

Another example sanitary oral interface of any other disclosed interface is provided, wherein the removal member is at least partially defined by the series separation portion.

Another example sanitary oral interface of any other disclosed interface is provided, wherein the base further comprises: a distal inhaling article interface portion adapted to couple the base with the inhaling article.

Another example sanitary oral interface of any other disclosed interface is provided, wherein the distal inhaling article interface portion includes a conformal portion that is adapted to conform to a predefined conformal portion of the inhaling article.

Another example sanitary oral interface of any other disclosed interface is provided, wherein the base is composed of a material that is more rigid than the material of which the plurality of separable sections is composed.

Another example sanitary oral interface of any other disclosed interface is provided, wherein the plurality of separable sections is composed of a material that is one or more of liquid resistant and antimicrobial.

Another example sanitary oral interface of any other disclosed interface is provided, wherein at least a radially lateral surface of each of the plurality of separable sections includes a material that is one or more of liquid resistant and antimicrobial.

An example method of using a sanitary oral interface for an inhaling article is provided, including radially decoupling a medial surface of an external separable section from a lateral surface of the external separable section, the medial surface being lateral relative to the lateral surface, wherein the operation of radially decoupling facilitates exposure of a series separation portion between the external separable section and an internal separable section; and series decoupling the exposed series separation portion.

An example method of making a sanitary oral interface for an inhaling article is provided, including forming a thin sheet; introducing series separation portions to the thin sheet forming a plurality of separable sections; introducing a radial coupling portion to the thin sheet at each of the plurality of separable sections; coupling an internal portion of the thin sheet to an external surface of a base; and wrapping the thin sheet around the base, the wrapping causing the radial coupling portion of a separable section to couple a medial surface of the separable section to a lateral surface of an external separable section of the plurality of separable sections, wherein the medial surface is lateral relative to the lateral surface when coupled.

Another example method of any other disclosed method is provided, further including coupling a distal inhaling article interface portion of the base to a portion of the inhaling article.

An example system of using a sanitary oral interface for an inhaling article is provided, including means for radially decoupling a medial surface of an external separable section from a lateral surface of the external separable section, the medial surface being lateral relative to the lateral surface, wherein the means for radially decoupling facilitates exposure of a series separation portion between the external separable section and an internal separable section; and means for series decoupling the exposed series separation portion.

An example system of making a sanitary oral interface for an inhaling article is provided, including means for forming a thin sheet; means for introducing series separation portions to the thin sheet forming a plurality of separable sections; means for introducing a radial coupling portion to the thin sheet at each of the plurality of separable sections; means for coupling an internal portion of the thin sheet to an external surface of a base; and means for wrapping the thin sheet around the base, the means for wrapping configured to cause the radial coupling portion of a separable section to couple a medial surface of the separable section to a lateral surface of an external separable section of the plurality of separable sections, wherein the medial surface is lateral relative to the lateral surface when coupled.

Another example system of any other disclosed system is provided, further including means for coupling a distal inhaling article interface portion of the base to a portion of the inhaling article.

While this specification contains many specific implementation details, these should not be construed as limitations on the scope of any technologies or of what may be claimed, but rather as descriptions of features specific to particular implementations of the particular described technology. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can, in some cases, be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order or that all illustrated operations be performed to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together into a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of implementations of the described technology have been described. Nevertheless, it will be understood that various modifications can be made without departing from the spirit and scope of the recited claims.

What is claimed is:

1. A sanitary oral interface for an inhaling article, comprising:

a frustoconical base configured to be coupled to the inhaling article including an exterior surface; and a frustoconical layered sanitary portion coupled about the exterior surface of the base, the layered sanitary portion including a plurality of separable sections layered in a spiral configuration around the base, each separable section formed of a polymeric liquid-resistant material being connected to another in series by a series connection interface.

2. The sanitary oral interface for an inhaling article of claim 1, wherein the series connection interface includes a weakened portion, wherein the weakened portion is adapted to decouple using less force than would damage interior portions of the plurality of separable sections.

3. The sanitary oral interface for an inhaling article of claim 1, wherein the series connection interface includes a weakened portion, the weakened portion including a perforation.

4. The sanitary oral interface for an inhaling article of claim 1, wherein the series connection interface includes a weakened portion, the weakened portion including a material thinner than an interior portion of a separable section.

5. The sanitary oral interface for an inhaling article of claim 1, wherein an external separable section of the plurality of separable sections extends further proximally relative to an internal separable section of the plurality of separable sections, the external separable section laterally circumferentially surrounding at least a portion of the internal separable section, the plurality of separable sections forming a distal-medial slope on a proximal end of the sanitary oral interface.

6. The sanitary oral interface for an inhaling article of claim 1, wherein an external separable section of the plurality of separable sections includes a radial coupling portion, the radial coupling portion radially coupling a lateral surface of the external separable section to a medial surface of the external separable section.

7. The sanitary oral interface for an inhaling article of claim 6, wherein the radial coupling portion is positioned at an interior portion of the external separable section causing a spirally outward portion of the external separable section to overlap with a spirally inward portion of the external separable section.

8. The sanitary oral interface for an inhaling article of claim 7, wherein the external separable section covers internal separable sections of the plurality of separable sections and wherein the radial coupling portion is positioned spirally outwardly relative to the series connection interface coupling the external separable section to one of the internal separable sections.

9. The sanitary oral interface for an inhaling article of claim 6, wherein the radial coupling portion is adapted to require less force to sever a radial coupling of the radial coupling portion than to damage the external separable section.

10. The sanitary oral interface for an inhaling article of claim 1, wherein at least one of the plurality of separable sections further comprises:

a removal member coupled to or integrated with a first separable section of the plurality of separable sections, wherein the removal member is radially uncoupled from other of the plurality of separable sections other than the first separable section.

11. The sanitary oral interface for an inhaling article of claim 10, wherein the removal member is at least partially exposed by removal of an external separable section of the plurality of separable sections radially external of the removal member.

12. The sanitary oral interface for an inhaling article of claim 10, wherein the removal member is at least partially defined by the series connection interface.

13. The sanitary oral interface for an inhaling article of claim 1, wherein the base further comprises:

an inhaling article interface adapted to couple the base with the inhaling article.

14. The sanitary oral interface for an inhaling article of claim 13, wherein the inhaling article interface includes a conformal portion that is adapted to conform to a predefined conformal portion of the inhaling article.

15. The sanitary oral interface for an inhaling article of claim 1, wherein the base is composed of a material that is more rigid than the material of which the plurality of separable sections is composed.

16. The sanitary oral interface for an inhaling article of claim 1, wherein the plurality of separable sections is composed of a material that is antimicrobial.

* * * * *